US009733034B1

(12) United States Patent
Viani

(10) Patent No.: US 9,733,034 B1
(45) Date of Patent: Aug. 15, 2017

(54) TRIGGER ASSEMBLY IMPROVED

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

(21) Appl. No.: 15/353,257

(22) Filed: Nov. 16, 2016

(51) Int. Cl.
*F41A 19/45* (2006.01)
*F41A 19/14* (2006.01)
*F41A 19/10* (2006.01)
*F41A 19/12* (2006.01)

(52) U.S. Cl.
CPC ..... *F41A 19/45* (2013.01); *F41A 19/10* (2013.01); *F41A 19/12* (2013.01); *F41A 19/14* (2013.01)

(58) Field of Classification Search
CPC ..... F41A 19/06; F41A 19/09; F41A 19/10; F41A 19/12; F41A 19/14; F41A 19/15; F41A 19/16; F41A 19/17; F41A 19/18; F41A 19/186; F41A 19/19; F41A 19/20; F41A 19/21; F41A 19/22; F41A 19/24; F41A 19/25; F41A 19/30; F41A 19/31; F41A 19/42; F41A 19/43; F41A 19/44; F41A 19/45; F41A 19/49
USPC ..... 42/69.01–69.03; 89/136, 139, 144, 146, 89/147, 149, 151, 154
See application file for complete search history.

(56) References Cited

U.S. PATENT DOCUMENTS 659,507 A 10/1900 Browning
1,892,141 A 12/1932 Garand
3,045,555 A 7/1962 Stoner
3,626,805 A * 12/1971 Shiplee, III ..... F41A 19/46 89/128
4,399,628 A * 8/1983 Franchi ..... F41A 17/74 42/42.01
5,881,485 A 3/1999 Milazzo
6,615,527 B1 9/2003 Martin
7,010,879 B2 3/2006 Olson
7,600,338 B2 10/2009 Geissele
7,854,084 B1 12/2010 Rutherford
7,992,335 B2 8/2011 Gangl
8,443,536 B1 5/2013 Geissele
8,661,722 B2 3/2014 Dionne et al.
8,844,423 B1 9/2014 Ubl et al.
8,881,442 B2 11/2014 Elftmann, Jr.
(Continued)

FOREIGN PATENT DOCUMENTS

WO 2013058857 A2 6/2013

*Primary Examiner* — Bret Hayes
(74) *Attorney, Agent, or Firm* — Albert Bordas, P.A.

(57) ABSTRACT

A trigger assembly improved, having a trigger assembly with first and second shroud side edges that define an angled face. The angled face tapers and is sufficiently wide to partially cover a trigger spring to reduce debris accumulation thereon. First and second housing sidewalls are countersunk and have at least one debris hole. A disconnector assembly has first and second disconnector side faces that define a spring well to house a disconnector spring. The disconnector assembly further has a disconnector shroud and disconnector shroud top face that are sufficiently wide to cover the spring well and the disconnector spring. A hammer assembly has first and second hammer spring mounts to secure a hammer spring. First, second, third and fourth hammer spring shrouds are sufficiently wide to partially cover the hammer spring. The hammer assembly further has first and second debris bevels that extend to first and second hammer sidewalls respectively.

23 Claims, 15 Drawing Sheets

(56) References Cited

U.S. PATENT DOCUMENTS

| | | | | |
|---|---|---|---|---|
| 8,985,006 | B1 | 3/2015 | Christensen et al. | |
| 9,046,313 | B1 | 6/2015 | Lutton et al. | |
| 9,146,066 | B1 | 9/2015 | Cason | |
| 9,207,027 | B1 | 12/2015 | Hannan et al. | |
| 9,310,150 | B1 * | 4/2016 | Geissele | F41A 19/16 |
| 9,347,725 | B2 | 5/2016 | McAlister | |
| 2005/0257676 | A1 | 11/2005 | Ealovega | |
| 2006/0086031 | A1 * | 4/2006 | Geissele | F41A 19/16 42/69.03 |
| 2006/0101695 | A1 | 5/2006 | Longueira | |
| 2014/0075812 | A1 | 3/2014 | Johnson | |
| 2014/0196267 | A1 | 7/2014 | Tiberius et al. | |
| 2015/0176938 | A1 | 6/2015 | Micklethwaite | |
| 2015/0211820 | A1 | 7/2015 | McRee | |
| 2015/0338181 | A1 | 11/2015 | McAlister | |
| 2016/0076850 | A1 | 3/2016 | Sullivan et al. | |
| 2016/0178304 | A1 * | 6/2016 | Geissele | F41A 19/10 42/69.01 |

* cited by examiner

TRIGGER ASSEMBLY IMPROVED

BACKGROUND OF THE INVENTION

1. Field of the Invention

The present invention relates to firearm accessories, and more particularly, to improved trigger assembly systems for firearms.

2. Description of the Related Art

Applicant believes that one of the closest references corresponds to U.S. Patent Application Publication No. 20160076850 A1, published on Mar. 17, 2016 to Brian E.

Sullivan, et al. for a pneumatic launcher system and method. However, it differs from the present invention because Sullivan, et al. teaches a projectile launcher that converts an airsoft gun to fire paintballs to handle feeding either airsoft projectiles or paintball projectiles. The launcher includes a hydraulic damper. It allows fire and reload to operate in a controlled motion that allows a projectile to be fired and the next projectile to be loaded in a rapid succession. An improved magazine allows multiple different types of projectiles to be installed in the magazine. An interchangeable trigger mechanism and interchangeable barrel launches different diameters of projectiles. Different types of firing mechanisms can be removed and interchanged in the launcher. In addition, the barrel can also be changed as the projectile is changed.

Applicant believes that another reference corresponds to U.S. Patent Application Publication No. 20150338181 A1, published on Nov. 26, 2015 to Kenneth McAlister for semiautomatic rifle trigger mechanism. However, it differs from the present invention because McAlister teaches methods and an apparatus for a semiautomatic rifle with a trigger in a receiver portion of the rifle positioned substantially forward of a back end of the rifle barrel, and a hammer assembly that includes a pivotally mounted sear, a disconnector, and a hammer mounted in the receiver behind the back end of the barrel. A hammer linkage proximate the hammer assembly has a first end connected to the trigger by a pull rod, and a second end configured to push a back end of the sear in an upward direction.

Applicant believes that another reference corresponds to U.S. Patent Application Publication No. 20150211820 A1, published on Jul. 30, 2015 to Scott McRee for bolt rifle assembly. However, it differs from the present invention because McRee teaches an expandable linear explosive shape charge positioner for severing tubular members, whereby a plurality of arc-shaped charge chambers are positioned along the same plane and adjacent to the interior walls of the tubular members and detonated to sever the tubular members. It's placed within a tubular member and includes a remotely extendible framework having remotely detonable linear explosive shape charges enclosed therein. When in a collapsed position, the apparatus passes through constrictions within the tubular members. When extended, the framework is positioned transversely to the axis of the tubular member with the shape charges positioned adjacent the interior walls thereof. Shape charge chambers with angled ends are presented to provide overlap when the device is fully extended to better ensure complete separation of the tubular member at the discontinuities of the shape charges about the plane of severance.

Applicant believes that another reference corresponds to U.S. Patent Application Publication No. 20150176938 A1, published on Jun. 25, 2015 to Rusell Micklethwaite for a rifle/shotgun combination and conversion method. However, it differs from the present invention because Micklethwaite teaches a rifle/shotgun combination firearm that includes a shotgun receiver portion and a lower receiver portion extending rearwardly from the shotgun receiver portion. A rifle trigger assembly is carried in the lower receiver portion and actuated by a rifle trigger coupled thereto. A shotgun trigger assembly is carried by the shotgun receiver portion and actuated by a shotgun trigger pivotally carried on a transversely oriented pivot pin in the lower receiver portion. A shotgun trigger transfer bar couples the shotgun trigger assembly to the shotgun trigger.

Applicant believes that another reference corresponds to U.S. Patent Application Publication No. 20140196267 A1, published on Jul. 17, 2014 to Benjamin T. Tiberius, et al. for a pneumatic system and method for simulated firearm training. However, it differs from the present invention because Tiberius, et al. teaches a training method that includes converting a firearm capable of firing live ammunition to a pneumatic training device incapable of firing live ammunition. The training method may further include cycling a pneumatic training device through one or more cycles. Each of the cycles may simulate an actual firing of the firearm. Each of the cycles may also include triggering a trigger assembly of the pneumatic training device, using a charge of a pressurized gas to reset the trigger assembly, and advancing a counter of the pneumatic training device. After a certain number of cycles have been completed, a next cycle may be attempted, but not completed. Accordingly, the training method may enable a user to practice reloading, jam or malfunction clearing, or the like.

Applicant believes that another reference corresponds to U.S. Patent Application Publication No. 20140075812 A1, published on Mar. 20, 2014 to Shawn Johnson for an AR-15 type bullpup converted firearm and method of assembly. However, it differs from the present invention because Johnson teaches a bullpup assembly for converting an AR-15 type firearm having an AR-15 stock in unmodified assembly into a bullpup configuration. The bullpup assembly includes a frame body coupleable with the body of the firearm, the frame comprising a bullpup trigger, and the frame being configured to replace the AR-15 stock, and a trigger link coupled with the bullpup trigger and coupleable with a firearm trigger of the firearm, wherein actuation of the bullpup trigger actuates the firearm trigger via the trigger link.

Applicant believes that another reference corresponds to U.S. Patent Application Publication No. 20060101695 A1, published on May 18, 2006 to Dino C. Longueira for a trigger/disconnector assembly for an AR-7 survival rifle. However, it differs from the present invention because Longueira teaches a method for retrofitting a rifle having an integral trigger/disconnector. The method comprises the steps of: removing the integral trigger/disconnector; and installing an assembly comprising a spring-loaded disconnector and a trigger in place of the integral trigger/disconnector. The spring-loaded disconnector is able to move to the rear when contacted by the hammer to allow the hammer to pass, and then quickly return to its forward position so as to capture the hammer.

Applicant believes that another reference corresponds to U.S. Patent Application Publication No. 20050257676 A1, published on Nov. 24, 2005 to George D. Ealovega for a weapon with electro-mechanical firing mechanism for use with combination percussive and an electrically responsive cartridge primer. However, it differs from the present invention because Ealovega teaches a weapon for utilizing a combination percussive and an electrically responsive cartridge primer that includes an electromechanical firing mechanism that operates to fire rounds percussively and electrically, and an electrical controller for regulating the firing of rounds electrically. A method of firing a combination percussive and electrically responsive cartridge primer includes mechanically firing a first round having the primer, and electrically firing subsequent rounds having the primer. A weapon may have an energy generating mechanism and a device for utilizing the energy, where the energy generating mechanism generates energy from the kinetic energy of one or more moving components. Alternately, the energy generating mechanism may include a thermoelectric generator.

Applicant believes that another reference corresponds to U.S. Pat. No. 9,347,725 B2 issued to Kenneth McAlister on May 24, 2016 for a semiautomatic rifle trigger mechanism. However, it differs from the present invention because McAlister teaches methods and an apparatus for a semiautomatic rifle with a trigger in a receiver portion of the rifle positioned substantially forward of a back end of the rifle barrel, and a hammer assembly that includes a pivotally mounted sear, a disconnector, and a hammer mounted in the receiver behind the back end of the barrel. A hammer linkage proximate the hammer assembly has a first end connected to the trigger by a pull rod, and a second end configured to push a back end of the sear in an upward direction.

Applicant believes that another reference corresponds to U.S. Pat. No. 9,207,027 B1 issued to Karl E. Hannan, et al. on Dec. 8, 2015 for a rifle dry-fire apparatus and method. However, it differs from the present invention because Hannan, et al. teaches a rifle lower receiver that has a trigger well and a magazine well. A hammer is disposed in the trigger well and configured to pivot from a first hammer position to a second hammer position in response to moving a trigger from a first trigger position to a second trigger position. A gear member attached to the lower receiver has a predefined number of gear teeth and a locking pin extending from the gear member. A pawl is connected to the trigger and operationally engages the gear member to increment the gear member once per trigger pull. Upon reaching a predefined number of trigger pulls, the locking member locks the trigger. A release lever on the lower receiver is operably configured to advance the gear member one increment to unlock the trigger. A method of dry-fire training is also disclosed.

Applicant believes that another reference corresponds to U.S. Pat. No. 9,146,066 B1 issued to Russell Cason on Sep. 29, 2015 for a bi-directional trigger. However, it differs from the present invention because Cason teaches a Bi-Directional Trigger assembly that comprises a trigger disconnector, and a fire selector. The trigger disconnector ratio of a length of a hammer hook attachment to the length of the hammer hook is about 5.46. The fire selector has an operational portion having an external diameter. The operational portion has a fire control recess with a depth. The ratio of the operational portion external diameter of the fire selector to the depth of the fire control recess of the operational portion of the fire selector being about 2.2.

Applicant believes that another reference corresponds to U.S. Pat. No. 9,046,313 B1 issued to William C. Lutton, et al. on Jun. 2, 2015 for an adjustable modular trigger assembly for firearms. However, it differs from the present invention because Lutton, et al. teaches an adjustable modular trigger assembly, and a related method, to avoid an unexpected firing of a long gun after an unintentional trigger pull. A modular trigger housing contains every trigger component and is removably mounted within a lower firearm receiver. A trigger pull adjustment screw is in a housing wall. A sear force adjustment screw is in another housing wall. During an intentional trigger pull, the shooter's finger pushes against a secondary trigger until it nestles within a slot of a non-coaxial primary trigger. Continued pulling on both triggers causes a sear to fall off a hammer notch and the firearm to discharge. In an unintentional trigger pull or jostling of the primary trigger, hooked protrusions within the housing of the second trigger and hammer engage to block the hammer from fully rotating, thereby avoiding discharge of the firearm.

Applicant believes that another reference corresponds to U.S. Pat. No. 8,985,006 B1 issued to Jason Christensen, et al. on Mar. 24, 2015 for a trigger assembly. However, it differs from the present invention because Christensen, et al. teaches a trigger assembly for use with a firearm, having a hook carried by and pivotal with a selector to engage an aft tab of a hammer in the safe position of the selector.

Applicant believes that another reference corresponds to U.S. Pat. No. 8,881,442 B2 issued to Arthur Joseph Elftmann, Jr. on Nov. 11, 2014 for a dual trigger for a semi-automatic rifle. However, it differs from the present invention because Elftmann, Jr. teaches a dual trigger assembly for a rifle. The assembly includes major components of the dual trigger and a trigger guard that is formed to accommodate the dual trigger. The dual trigger assembly may replace a single trigger assembly without the need for machining the rifle that will be provided with the dual trigger assembly.

Applicant believes that another reference corresponds to U.S. Pat. No. 8,844,423 B1 issued to Timothy Ubl, et al. on Sep. 30, 2014 for blowback bolt upper receiver and barrel assembly. However, it differs from the present invention because Ubl, et al. teaches a modified upper receiver assembly and method of assembly, which is fitted to a conventional lower receiver of a rifle so a user can use their normal lower receiver having a pistol grip, trigger assembly and butt stock. The upper receiver is configured to provide a blowback bolt assembly of larger mass than would be possible with similar density materials of a bolt fitted within an upper receiver conventionally made for said lower receiver.

Applicant believes that another reference corresponds to U.S. Pat. No. 8,661,722 B2 issued to Bruce Dionne, et al. on Mar. 4, 2014 for a firearm selector switch locking apparatus. However, it differs from the present invention because Dionne, et al. teaches a lockable safety selector switch adapted to replace a manufacturer's original safety selector switch for a firearm having a selector detent pin with a tip. The lockable safety selector switch has a body adapted to selectively orient between a SAFE position that prevents the firearm from firing, and a FIRE position that allows the firearm to fire, and a locking mechanism configured to operatively associate with the firearm selector detent pin to selectively lock the body in the SAFE position. The locking mechanism has a spring-loaded cam that operatively interfaces with a key to prevent unintentional locking or unlocking of the locking mechanism. The locking mechanism is operated by a key adapted to operate a handcuff lock. The lockable safety selector switch is configured such that the firearm requires no modification for the lockable safety selector switch to replace the original safety selector switch.

Applicant believes that another reference corresponds to U.S. Pat. No. 8,443,536 B1 issued to William Hugo Geissele on May 21, 2013 for an adjustable dual stage trigger mechanism for semi-automatic weapons. However, it differs from the present invention because Geissele teaches a dual stage trigger assembly for a firearm. The trigger assembly comprises a spring loaded lightweight hammer, a spring loaded trigger, a spring loaded disconnector, a spring follower for the disconnector spring and two adjustment screws that allow a user the ability to adjust a sear face of the trigger that is engaged with the hammer in a cocked position and adjust a force imparted to the disconnector by the disconnector spring.

Applicant believes that another reference corresponds to U.S. Pat. No. 7,992,335 B2 issued to John Gangl on Aug. 9, 2011 for a modular insertion trigger method and apparatus. However, it differs from the present invention because Gangl teaches a trigger assembly comprising a housing adapted to mount a trigger, hammer and sear therein. The housing has an adjustment feature adapted to fixedly mount the housing within the trigger chamber portion of the firearm. The trigger assembly is particularly conducive for an AR-15 type rifle. A safety system is employed that adjustably allows proper engagement of the trigger tail to properly engage and disengage the safety mechanism.

Applicant believes that another reference corresponds to U.S. Pat. No. 7,854,084 B1 issued to Foid D. Rutherford on Dec. 21, 2010 for an AR15-T400 hook-under trigger assembly. However, it differs from the present invention because Rutherford teaches a disconnector for a rifle wherein the disconnector is formed with a hook-under portion which is provided with a sharp trigger body contact ridge, which contacts on a center line, rifle longitudinal axis, of the underside of a portion of the trigger body when the disconnector is in a neutral position during the first stage of a two stage trigger pull.

Applicant believes that another reference corresponds to U.S. Pat. No. 7,600,338 B2 issued to William H. Geissele on Oct. 13, 2009 for multi-stage trigger for automatic weapons. However, it differs from the present invention because Geissele teaches a two-stage trigger assembly for M16 or AR15 weapon systems. The trigger assembly comprises a spring loaded hammer, trigger and disconnector. Calibrated springs are provided to facilitate the adjustment of the second stage trigger pull weight. No set screws adjustments are necessary and a secondary safety sear prevents the unintentional mechanical discharge of the firearm.

Applicant believes that another reference corresponds to U.S. Pat. No. 7,010,879 B2 issued to Douglas D. Olson on Mar. 14, 2006 for trigger assemblies for grenade launcher attachments to gas-operated rifles. However, it differs from the present invention because Olson teaches grenade launchers for attachment to gas-operated service rifles and carbines such as the M16 and M4 improved by providing them with a trigger assembly that enables the shooter to deliver repeated hammer strikes to the primer of the loaded grenade without having to open the breach to reset the hammer and signals final aim indication via added trigger pull force.

Applicant believes that another reference corresponds to U.S. Pat. No. 6,615,527 B1 issued to Derrick M. Martin on Sep. 9, 2003 for a trigger mechanism. However, it differs from the present invention because Martin teaches a firearm having a trigger assembly with a trigger nose, a hammer with a sear hook and a trigger notch, a disconnector and an automatic sear, a notched bifurcating the sear hook of the hammer for receiving the disconnector in a past-cocked position. The trigger notch is offset rearwardly from a center of the pivot point resulting in a slightly changed angle away from an acute engagement angle with the trigger nose.

Applicant believes that another reference corresponds to U.S. Pat. No. 5,881,485 A issued to Charles R. Milazzo on Mar. 16, 1999 for a multi-stage match trigger assembly for use with semi-automatic weapons. However, it differs from the present invention because Milazzo teaches a multi-stage trigger assembly for use by a shooter of a firearm. It comprises a trigger, a disconnector, disconnector spring, and a hammer. The trigger and the hammer each include a respective engagement means for engaging each other so that the hammer is held in a cocked position by the trigger before the trigger is pulled. The hammer further includes a contact means for contacting the disconnector so that when the trigger is first pulled, the first stage, the contact means contacts the disconnector at a predetermined time and increases the pressure required to pull the trigger completely and disengage the engagement means of the hammer and the trigger, the second stage. Additionally, the disconnector is spring loaded by the disconnector spring and pivotally connected to the trigger. The disconnector interacts with the hammer, which further includes a contact means for contacting the disconnector so that when the trigger is first pulled, the first stage, the contact means perceptibly contacts a cam like surface on the disconnector at a predetermined time where minimal engagement between the engagement means of the hammer and trigger is reached. The disconnector spring increases the pressure required to pull the trigger completely and disengage the engagement means of the hammer and the trigger, the second stage. This stop, or noticeable contact indicates to the shooter that the limited minimal engagement of the second stage has been reached.

Applicant believes that another reference corresponds to U.S. Pat. No. 3,045,555 issued to E. M. Stoner on Jul. 24, 1962 for an Automatic trigger mechanism with three sears and a rotatable control member. However, it differs from the present invention because Stoner teaches a hammer, a trigger, an intermediate sear and an automatic sear pivotally mounted in juxtaposition to each other within the receiver of a gun. The hammer, intermediate sear and an automatic sear being subject to control by a single control member, which by its position, determines whether the gun is maintained in safety condition, in semi-automatic fire condition or automatic fire condition.

Applicant believes that another reference corresponds to U.S. Pat. No. 1,892,141 issued to J. C. Garand on Dec. 27, 1932 for a semiautomatic rifle. However, it differs from the present invention because Garand teaches a guard and trigger assembly which may be secured to or removed from the receiver as a unit and in which there is provided a latch for firmly securing the unit to the receiver, a safety which also serves to hold the latch in latching position and resilient means for holding the trigger, and actuating the striker and safety.

Applicant believes that another reference corresponds to U.S. Pat. No. 659,507 issued to J. M. Browning on Oct. 9, 1900 for a recoil operated firearm. However, it differs from the present invention because Browning teaches automatic portable firearms of the class in which a recoil following an explosion of a cartridge in a gun barrel is utilized to operate a breech mechanism of a gun.

Applicant believes that another reference corresponds to WIPO Publication No. WO 2013058857 A2 published to Shawn Johnson on Jun. 20, 2013 for A3 AR-15 Type Bullpup Converted Firearm and Method of Assembly Thereof. However, it differs from the present invention because Johnson teaches a bullpup assembly for converting an AR-15 type firearm having an AR-15 stock in unmodified assembly into a bullpup configuration. The bullpup assembly includes a frame body coupleable with the body of the firearm, the frame comprising a bullpup trigger, and the frame being configured to replace the AR-15 stock, and a trigger link coupled with the bullpup trigger and coupleable with a firearm trigger of the firearm, wherein actuation of the bullpup trigger actuates the firearm trigger via the trigger link.

Other patents describing the closest subject matter provide for a number of more or less complicated features that fail to solve the problem in an efficient and economical way. None of these patents suggest the novel features of the present invention.

SUMMARY OF THE INVENTION

The present invention is a trigger assembly improved to mitigate debris accumulation, comprising a trigger assembly, a disconnector assembly, and a hammer assembly.

The trigger assembly comprises first and second housing side edges. The second housing side edge is a first predetermined distance from the first housing side edge. The first and second housing side edges each define first and second housing sidewalls respectively. The first and second housing sidewalls define an elongated cavity having an end. Protruding are first and second trigger spring mounts to secure a trigger spring. The first and second trigger spring mounts define a first trigger pin hole.

The trigger assembly further comprising first and second shroud side edges that define an angled face. The angled face tapers outwardly towards the end without reaching the end. The angled face is sufficiently wide to partially cover the trigger spring. The first and second housing sidewalls are countersunk to serve for debris deflection. The first and second housing sidewalls comprise at least one debris hole to evacuate debris therein. The trigger assembly further comprises first and second trigger assembly shroud sidewalls. The first and second trigger assembly shroud sidewalls are countersunk to serve for debris deflection. The angled face extends to a rounded top edge. The trigger assembly further comprises an aft face, a trigger sear, and a trigger.

The disconnector assembly comprises first and second disconnector side faces that define a spring well to house a disconnector spring, and a disconnector stopper. The disconnector assembly further comprises a disconnector shroud and disconnector shroud top face that are sufficiently wide to cover and protect the spring well and the disconnector spring from debris penetration.

The second disconnector side face is a second predetermined distance from the first disconnector side face. The first and second disconnector side faces comprise a second trigger pin hole that aligns with the first trigger pin hole. The disconnector assembly further comprises a disconnector tongue. Extending from the disconnector tongue is a disconnector top face. Extending from the disconnector top face are first and second tapered disconnector shroud edges that define the disconnector shroud. The disconnector shroud is further defined by first and second disconnector shroud edges. The first and second disconnector shroud edges extend to first and second disconnector shroud side edges respectively. The second disconnector shroud side edge is a third predetermined distance from the first disconnector shroud side edge. The disconnector assembly further comprises first and second disconnector shroud sidewalls that are countersunk to serve for debris deflection.

The hammer assembly has first and second hammer spring mounts to secure a hammer spring. The hammer assembly further comprises first and second hammer tapered shroud edges. The hammer assembly further comprises first and second hammer spring shrouds that extend from the first and second hammer tapered shroud edges respectively. The first and second hammer spring shrouds extend to a hammer sear. The hammer assembly further comprises third and fourth hammer spring shrouds. The third and fourth hammer spring shrouds extend from the hammer sear. The third and fourth hammer spring shrouds extend from the hammer sear to first and second hammer shroud ends respectively. The first, second, third and fourth hammer spring shrouds are sufficiently wide to encase and partially cover the hammer spring. The hammer assembly further comprises first and second debris bevels that extend to first and second hammer sidewalls respectively.

The hammer assembly further comprises first and second hammer assembly sidewalls. The first and second hammer assembly sidewalls are countersunk to serve for debris deflection. The first and second hammer assembly sidewalls comprise at least one debris hole to reduce debris accumulation therein.

It is therefore one of the main objects of the present invention to provide a trigger assembly improved comprising a trigger assembly that secures a trigger spring.

It is another object of this invention to provide a trigger assembly improved comprising an angled face that is sufficiently wide to partially cover the trigger spring to reduce debris accumulation thereon.

It is another object of this invention to provide a trigger assembly improved comprising a disconnector assembly that secures a disconnector spring.

It is another object of this invention to provide a trigger assembly improved comprising a disconnector shroud and disconnector shroud top face that are sufficiently wide to cover a spring well and the disconnector spring to reduce debris accumulation thereon.

It is another object of this invention to provide a trigger assembly improved comprising a hammer assembly that encases and secures a hammer spring.

It is another object of this invention to provide a trigger assembly improved comprising spring shrouds are sufficiently wide to encase, and partially cover the hammer spring to reduce debris accumulation thereon.

It is another object of this invention to provide a trigger assembly improved, which is of a durable and reliable construction.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
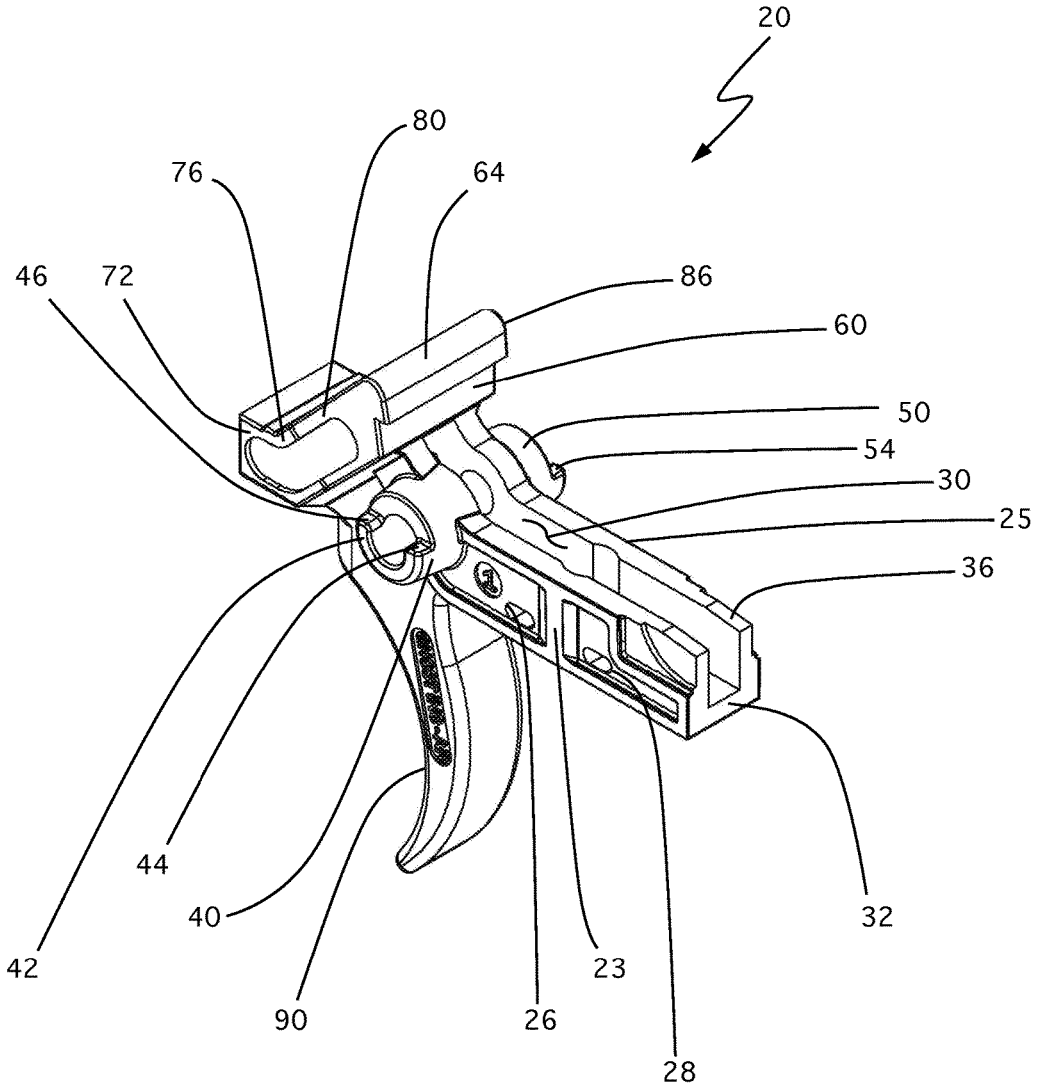
FIG. 1 represents an isometric view of a trigger assembly.
Figure 2:
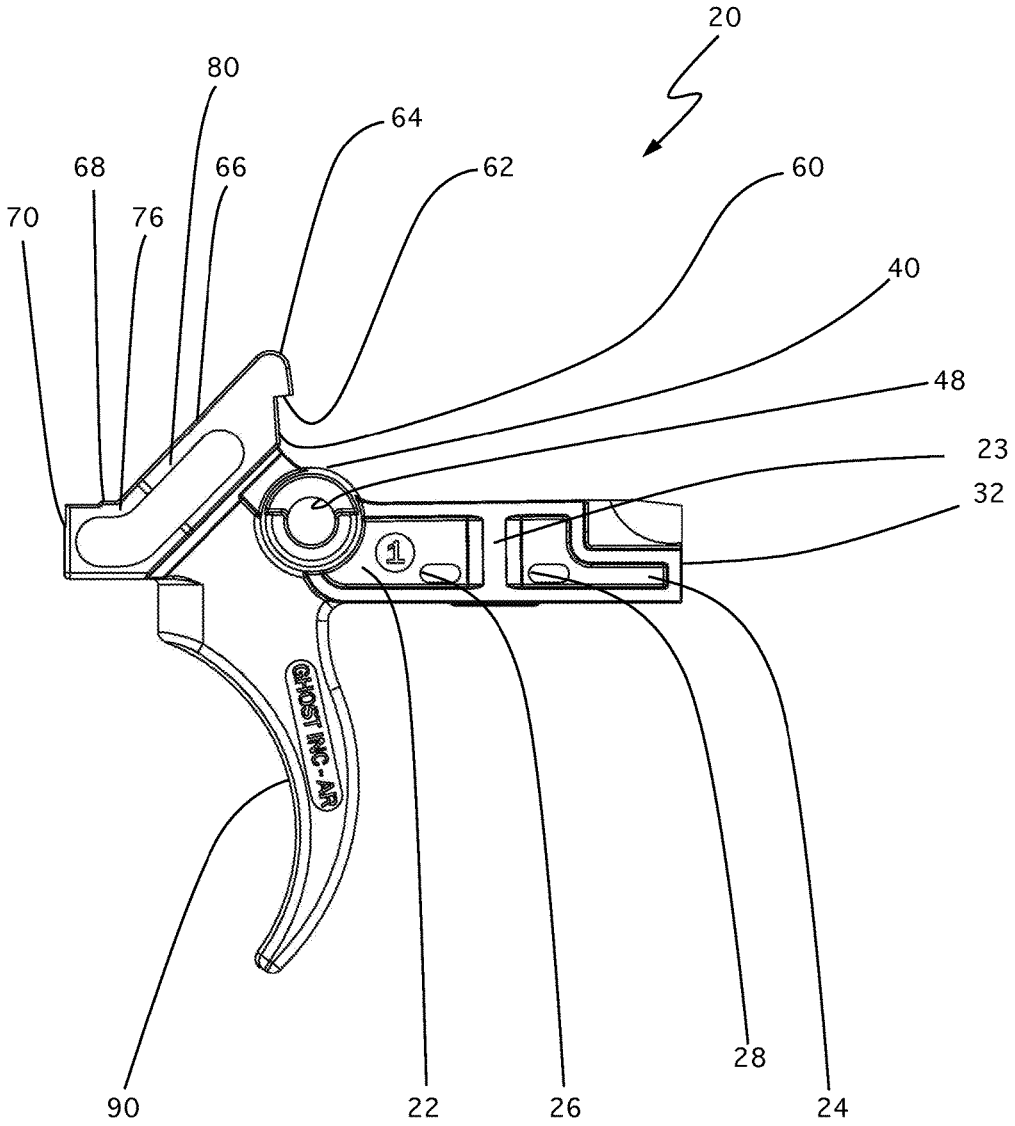
FIG. 2 is a side elevation view of the trigger assembly.
Figure 3:
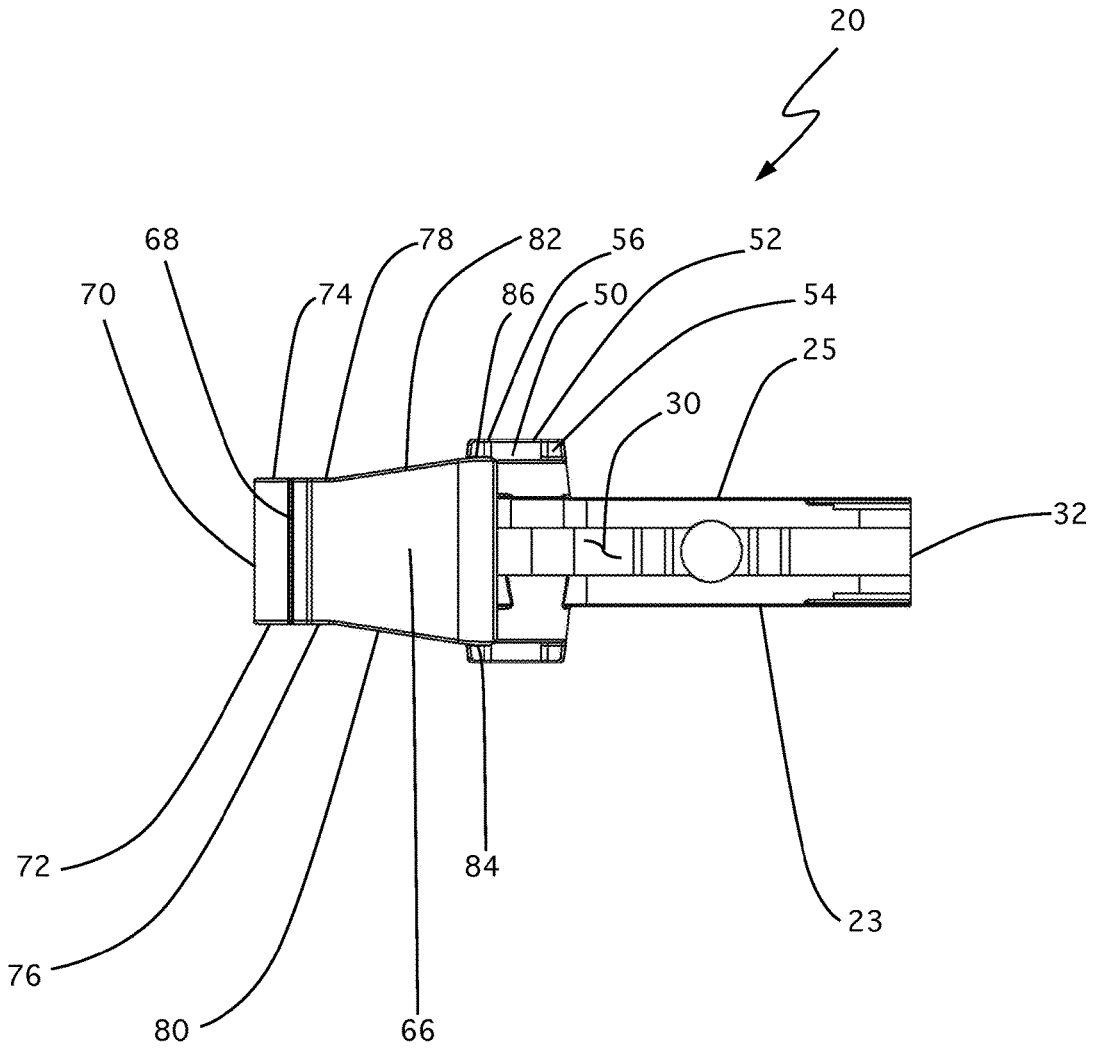
FIG. 3 is a top view of the trigger assembly.

Referring now to the drawings, the present invention is a trigger assembly improved and is generally referred to with numeral 10. It can be observed that it basically includes trigger assembly 20, disconnector assembly 100, and hammer assembly 170.

As seen in FIGS. 1, 2, 3, and 4, trigger assembly 20 has first and second housing side edges 23 and 25 respectively. Second housing side edge 25 is a first predetermined distance from first housing side edge 23. First and second housing side edges 23 and 25 each define first and second housing sidewalls 22 and 24 respectively. In a preferred embodiment, first and second housing sidewalls 22 and 24 are countersunk to serve for debris deflection, and comprise at least one debris hole 26 and/or 28 to reduce debris accumulation therein. In a preferred embodiment, the inside perimeters of the countersunk walls are filleted. First and second housing sidewalls 22 and 24 define elongated cavity 30 having end 32. End 32 extends to selector ledge 36. Debris, as an example may be, but is not limited to, dirt, oil, sand, powder, carbon, and/or shavings, or combinations thereof.

Figure 13:
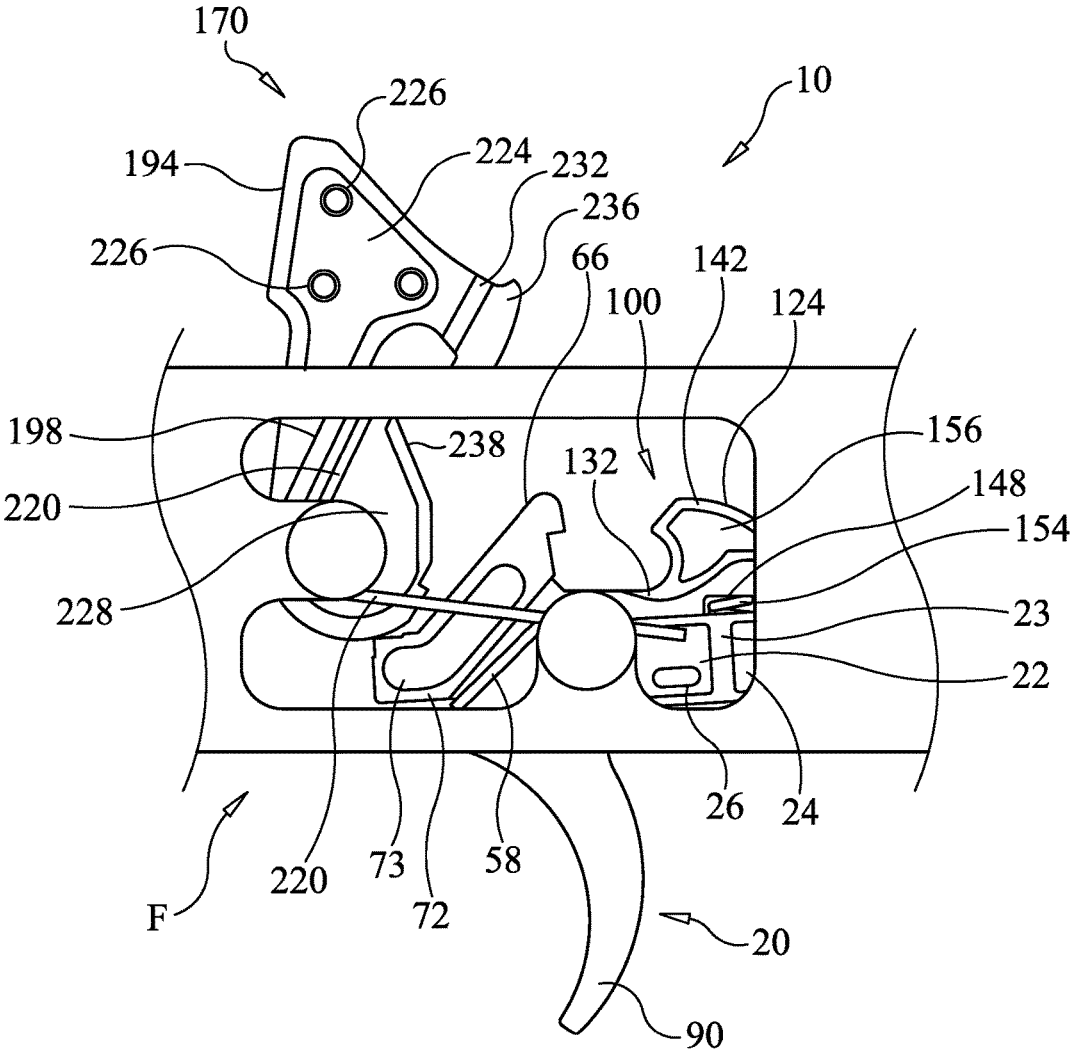
FIG. 13 is a side elevation view of the present invention mounted onto a firearm model in an at rest position.
Figure 14:
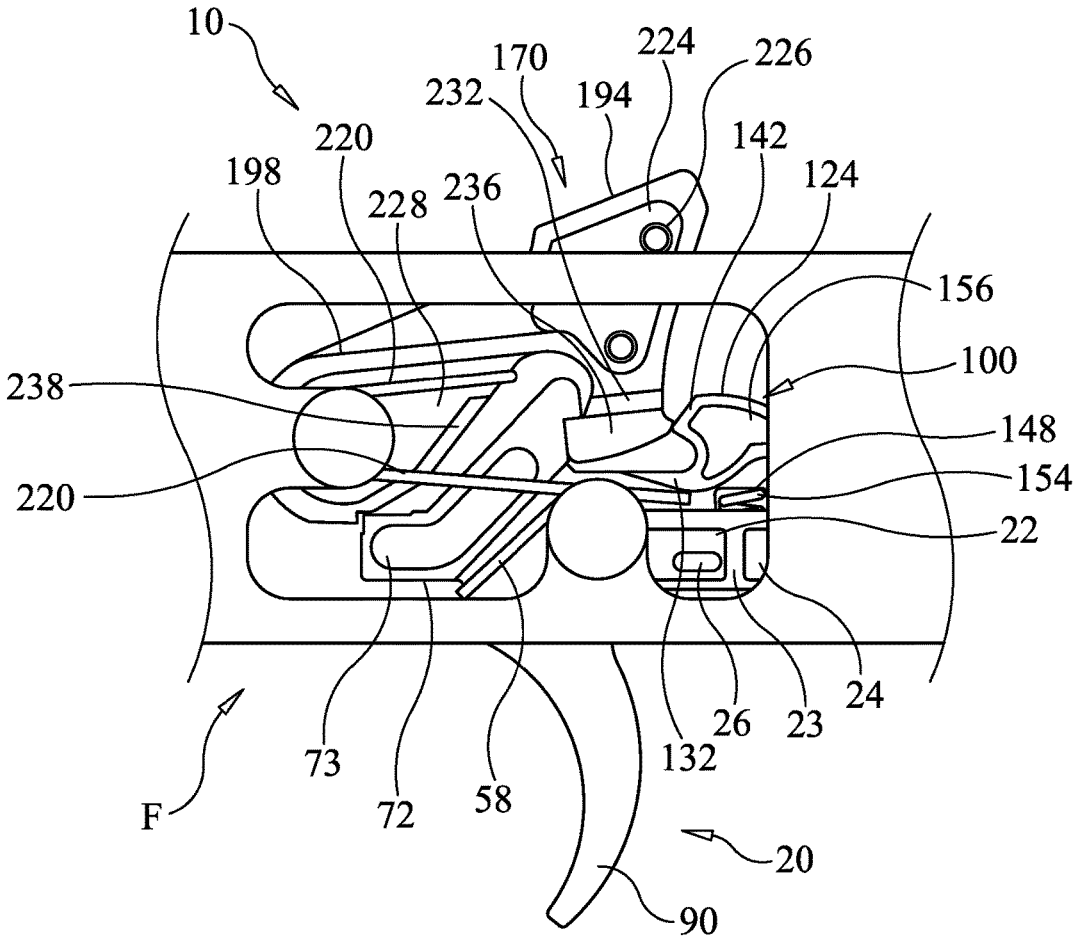
FIG. 14 is a side elevation view of the present invention mounted onto the firearm model in a cocked position.
Figure 15:
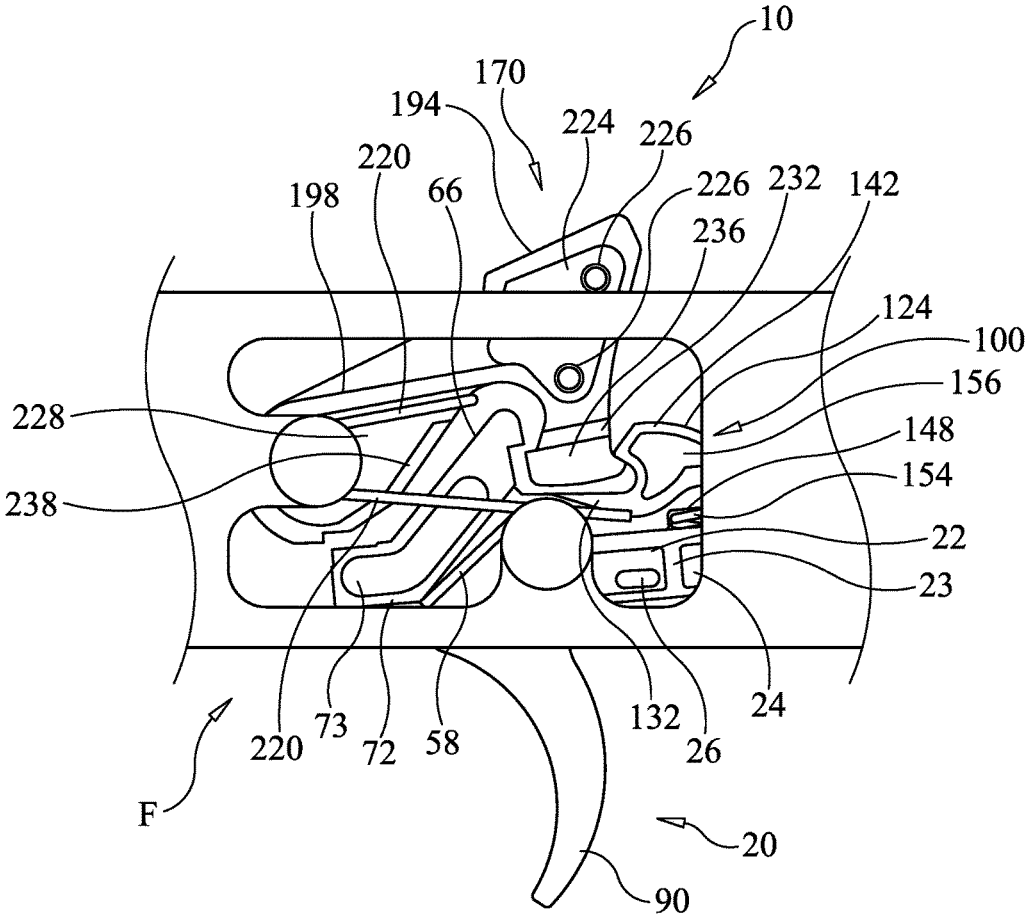
FIG. 15 is a side elevation view of the present invention mounted onto the firearm model in a reset position.

Protruding partially from first housing sidewalls 22 are first and second trigger spring mounts 40 and 50 respectively to secure trigger spring 58, seen in FIGS. 13, 14, and 15. First and second trigger spring mounts 40 and 50 define first trigger pin hole 48. First trigger spring mount 40 comprises trigger spring mount edge 42 having trigger spring mount ends 44 and 46. Similarly, second trigger spring mount 50 comprises trigger spring mount edge 52 having trigger spring mount ends 54 and 56.

Trigger assembly 20 further comprises forward ridge 70 having sidewall edges 72 and 74 that extend to sidewall end edges 76 and 78 respectively. Sidewall edges 72 and 74 and sidewall end edges 76 and 78 define first and second trigger assembly shroud sidewalls 73. First and second trigger assembly shroud sidewalls 73 are countersunk to serve for debris deflection. In a preferred embodiment, the inside perimeters of the countersunk walls are filleted. Trigger assembly 20 further comprises top ridge 68. Trigger assembly 20 further comprises first and second shroud side edges 80 and 82 that extend to shroud sidewall ends 84 and 86 respectively and define angled face 66. Angled face 66 tapers outwardly towards end 32 without reaching end 32. Angled face 66 is sufficiently wide to partially cover trigger spring 58, seen in FIGS. 13, 14, and 15, to reduce debris accumulation thereon. Angled face 66 extends to rounded top edge 64. Trigger assembly 20 further comprises aft face 60 and trigger sear 62. Trigger assembly 20 further comprises trigger 90. In a preferred embodiment, trigger assembly 20 is approximately symmetrical.

Figure 4:
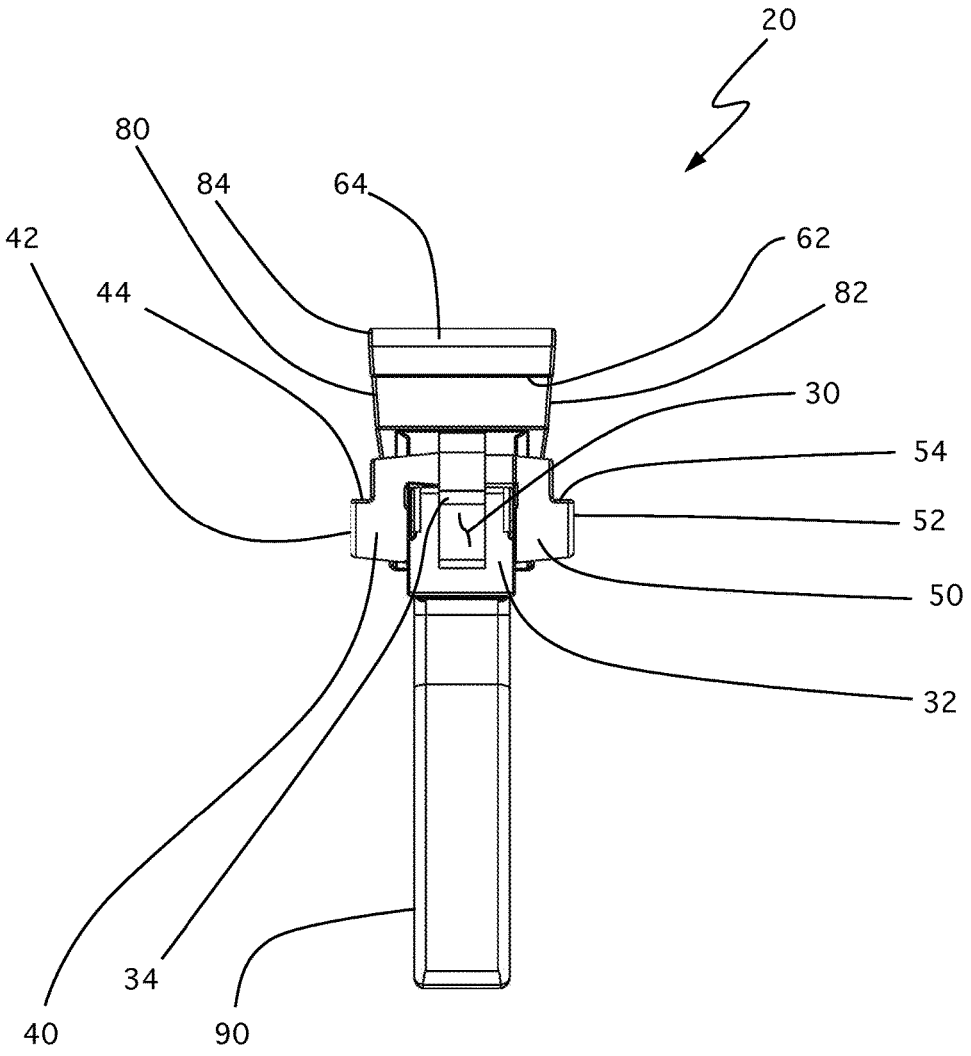
FIG. 4 is a rear view of the trigger assembly.
Figure 5:
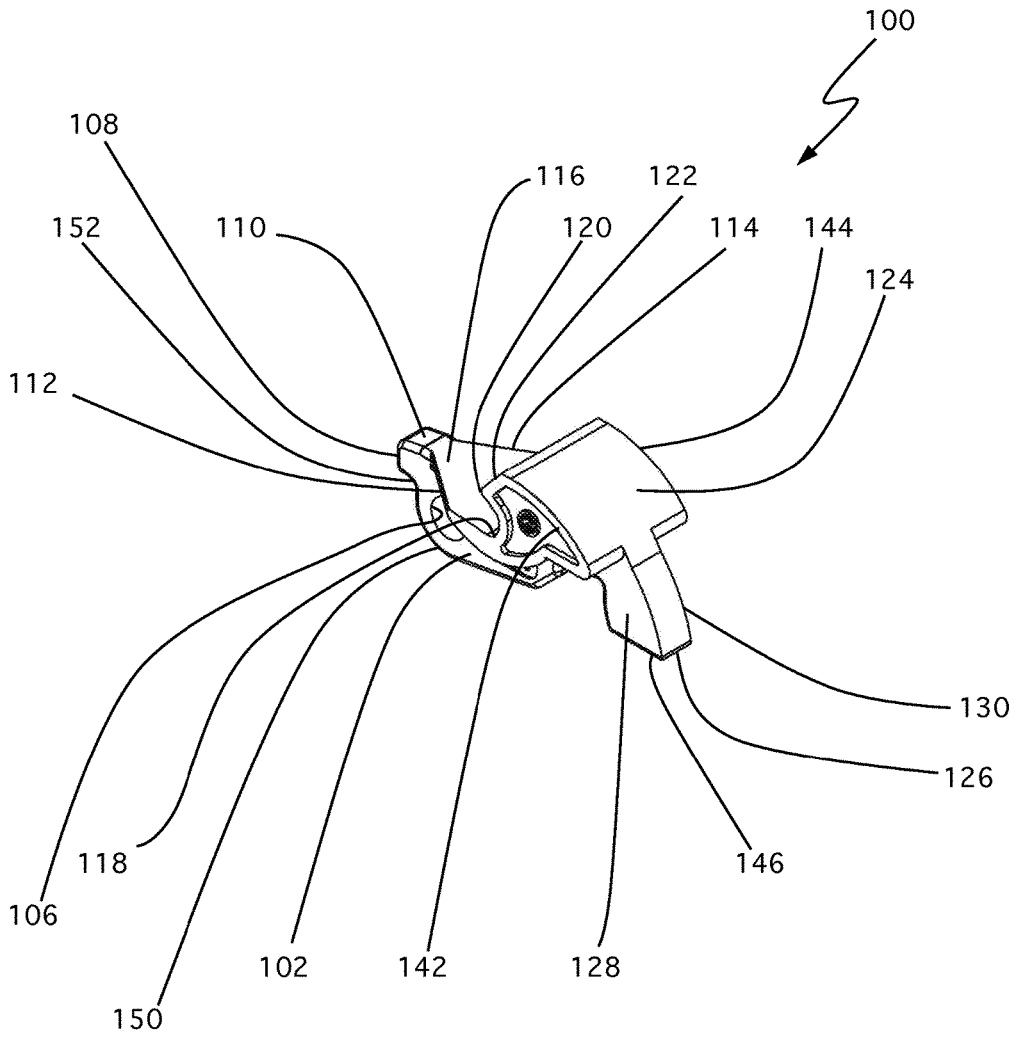
FIG. 5 represents an isometric view of a disconnector assembly.
Figure 6:
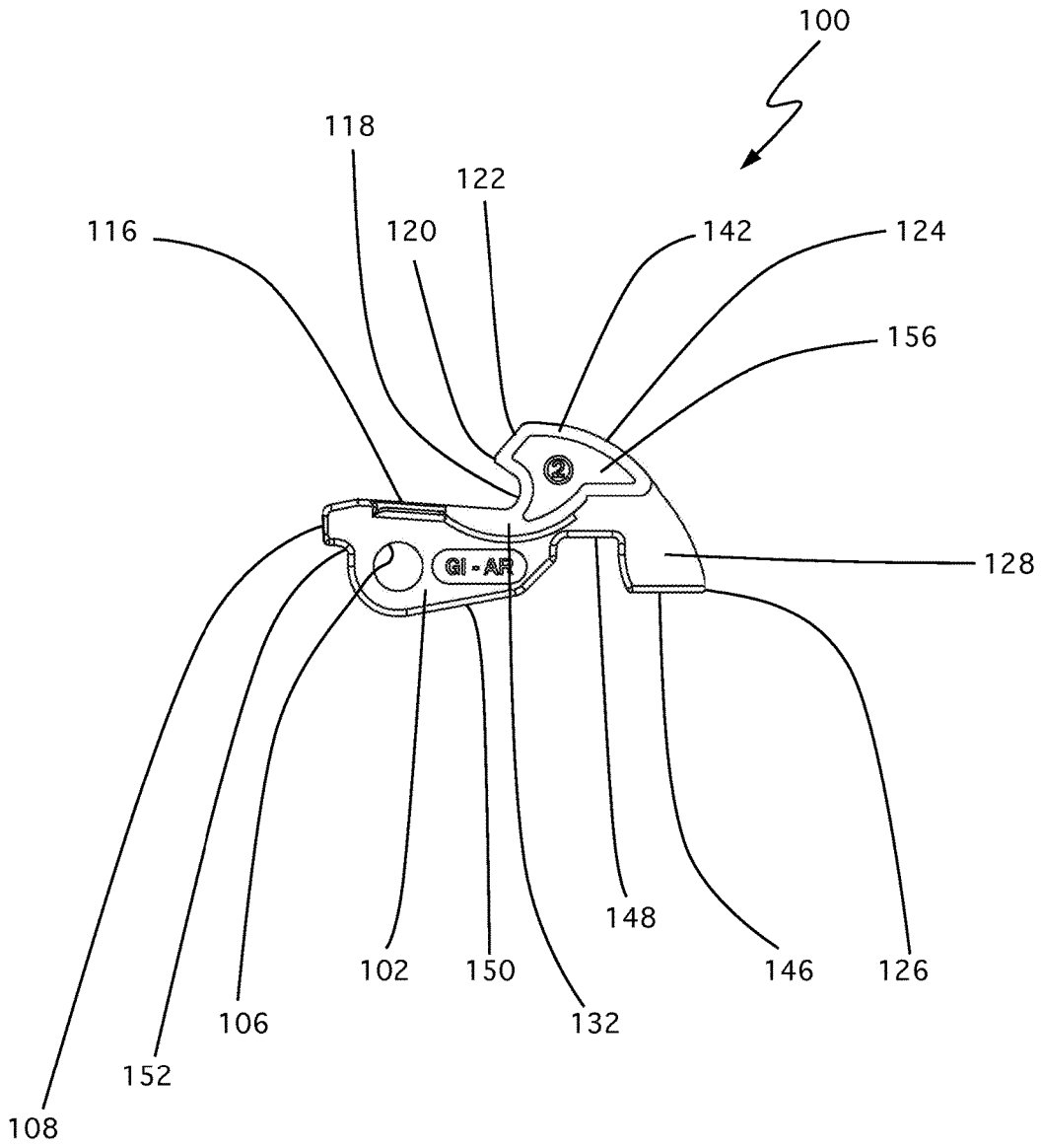
FIG. 6 is a side elevation view of the disconnector assembly.
Figure 7:
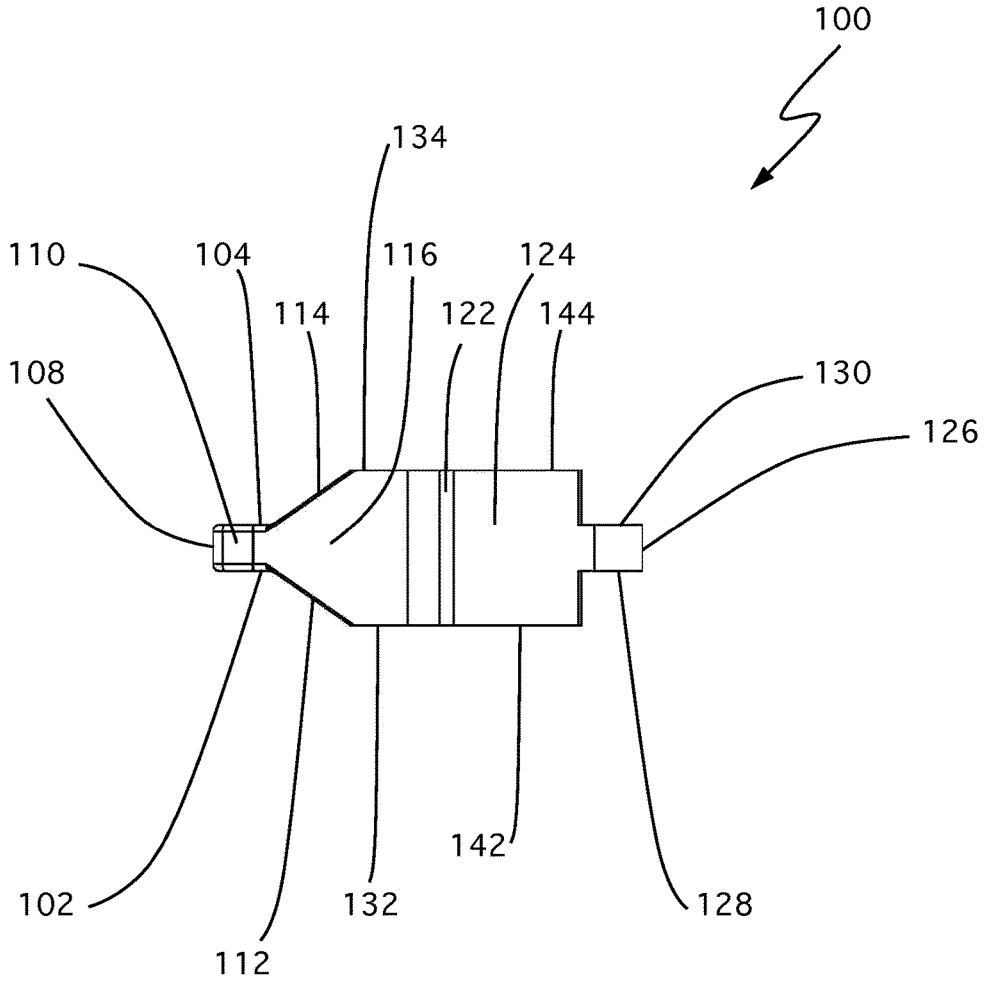
FIG. 7 is a top view of the disconnector assembly.
Figure 8:
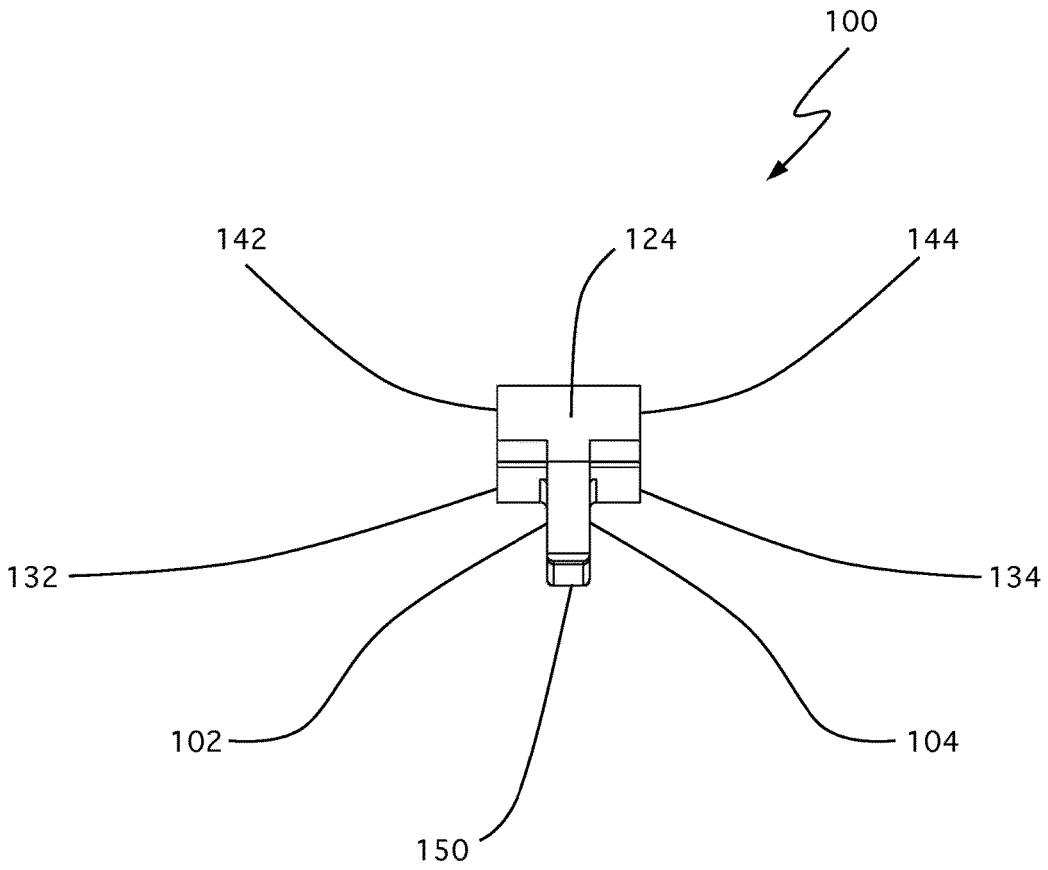
FIG. 8 is a rear view of the disconnector assembly.
Figure 9:
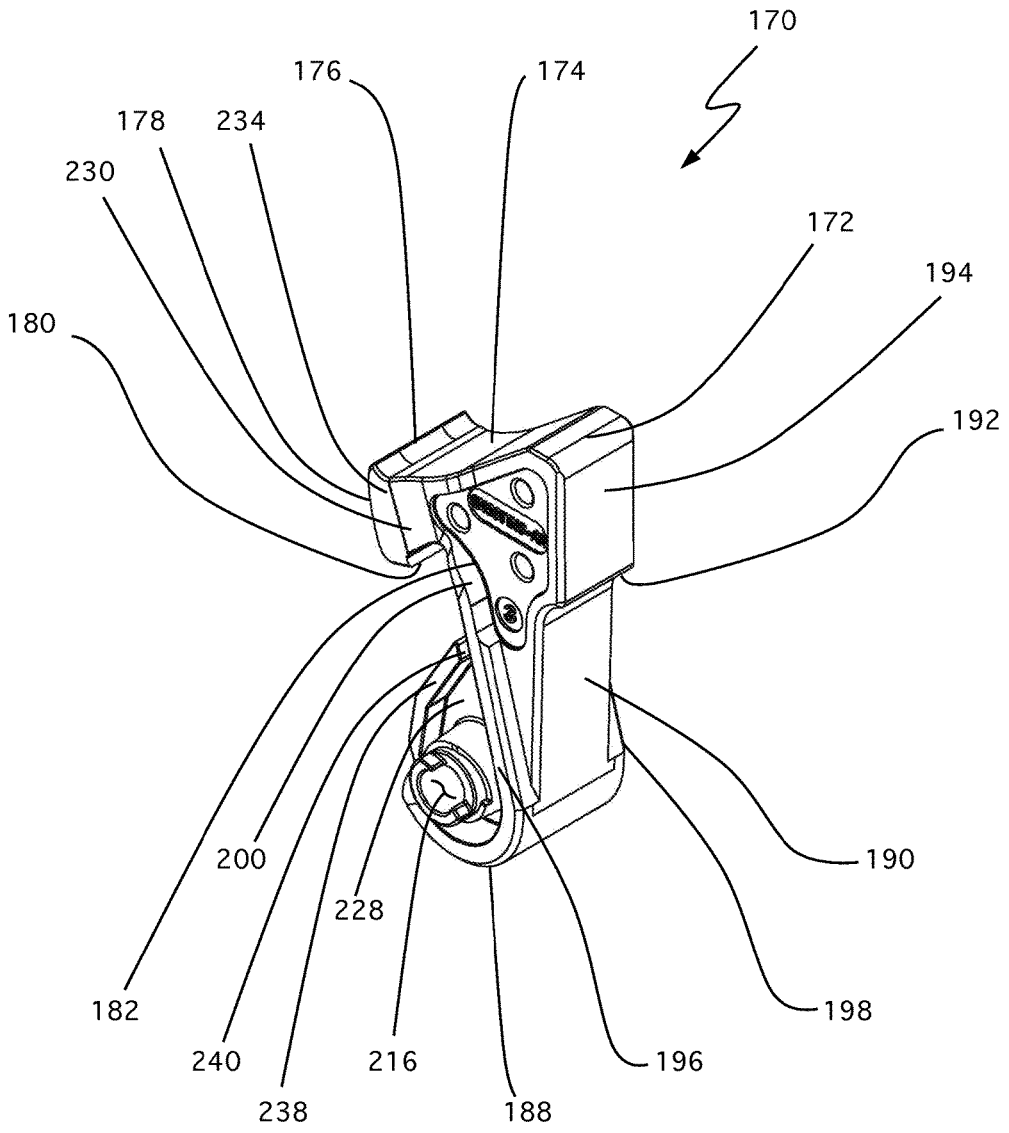
FIG. 9 represents an isometric view of a hammer assembly.
Figure 10:
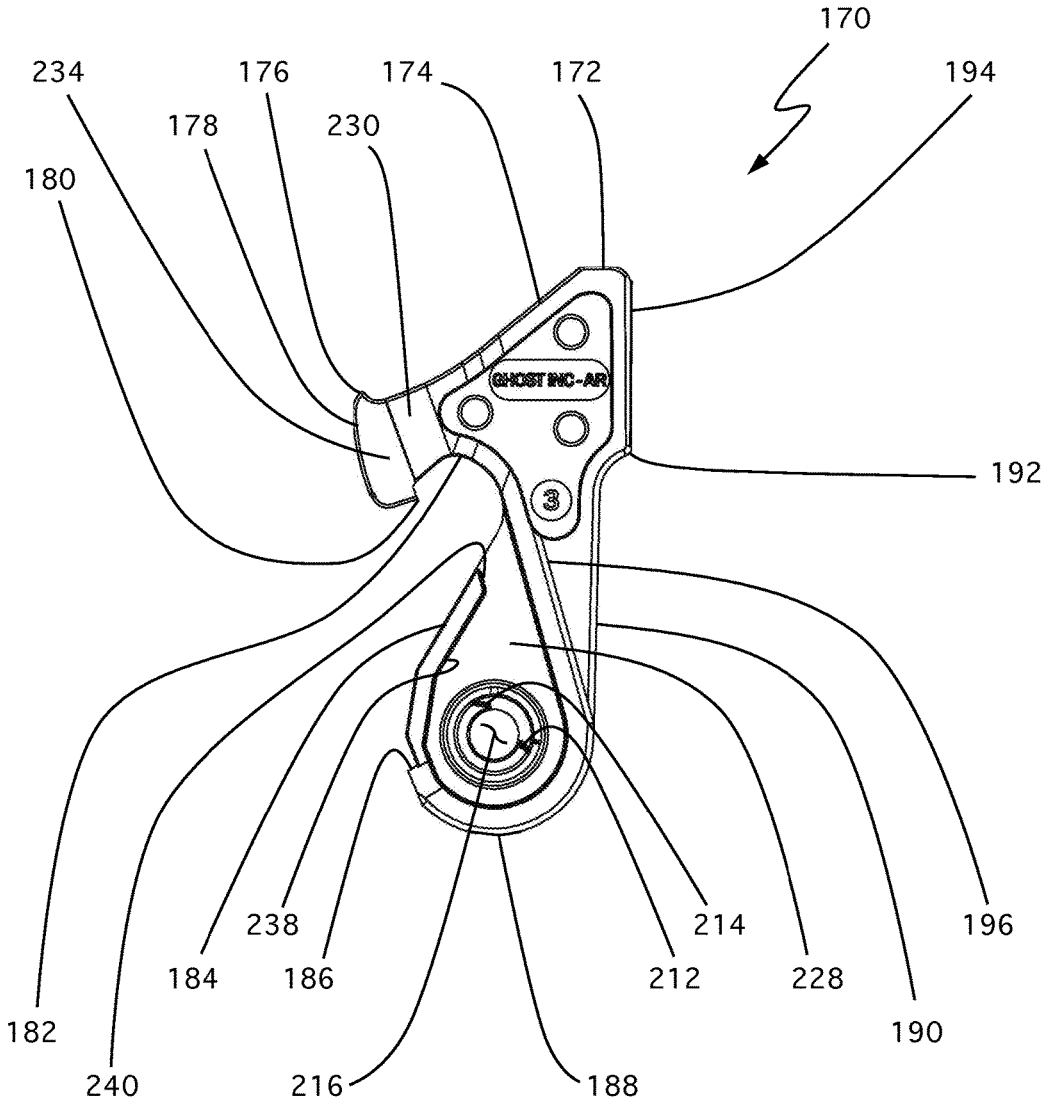
FIG. 10 is a side elevation view of the hammer assembly.
Figure 11:
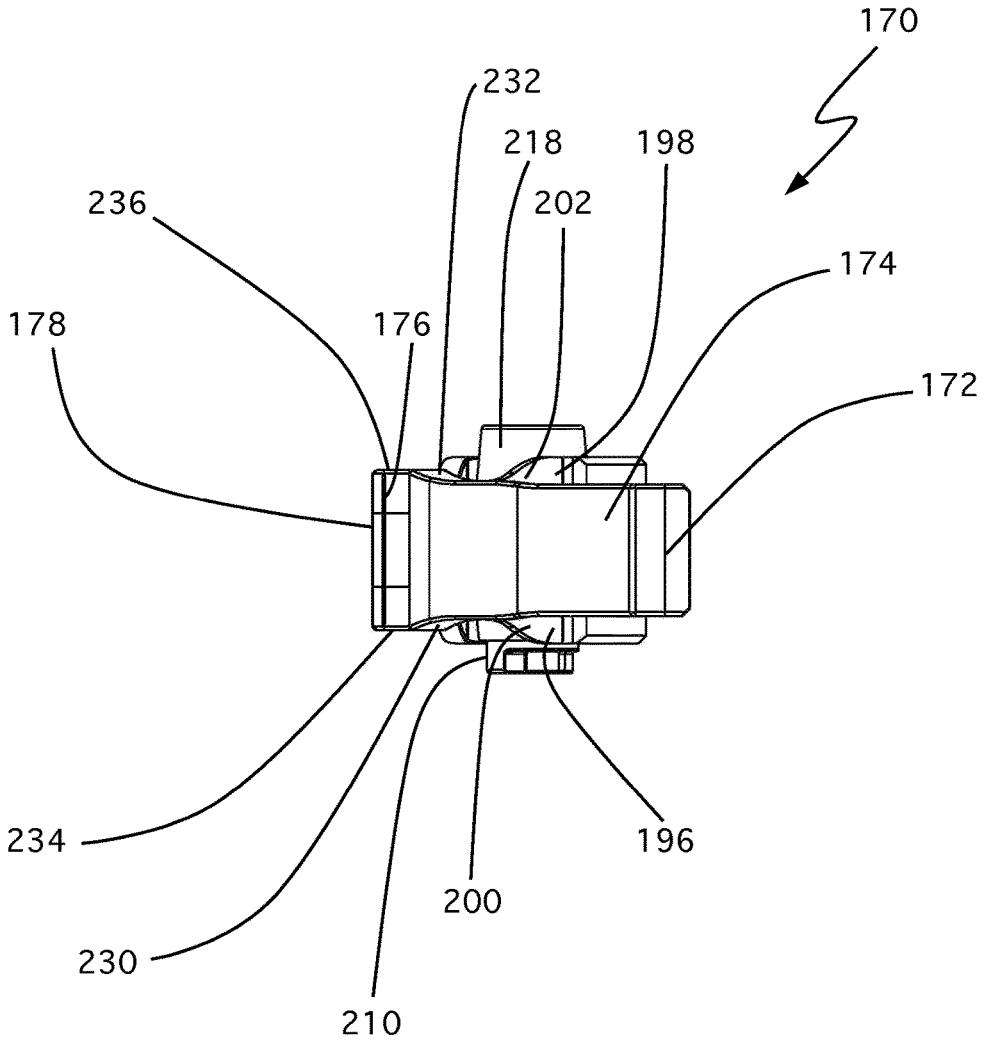
FIG. 11 is a top view of the hammer assembly.
Figure 12:
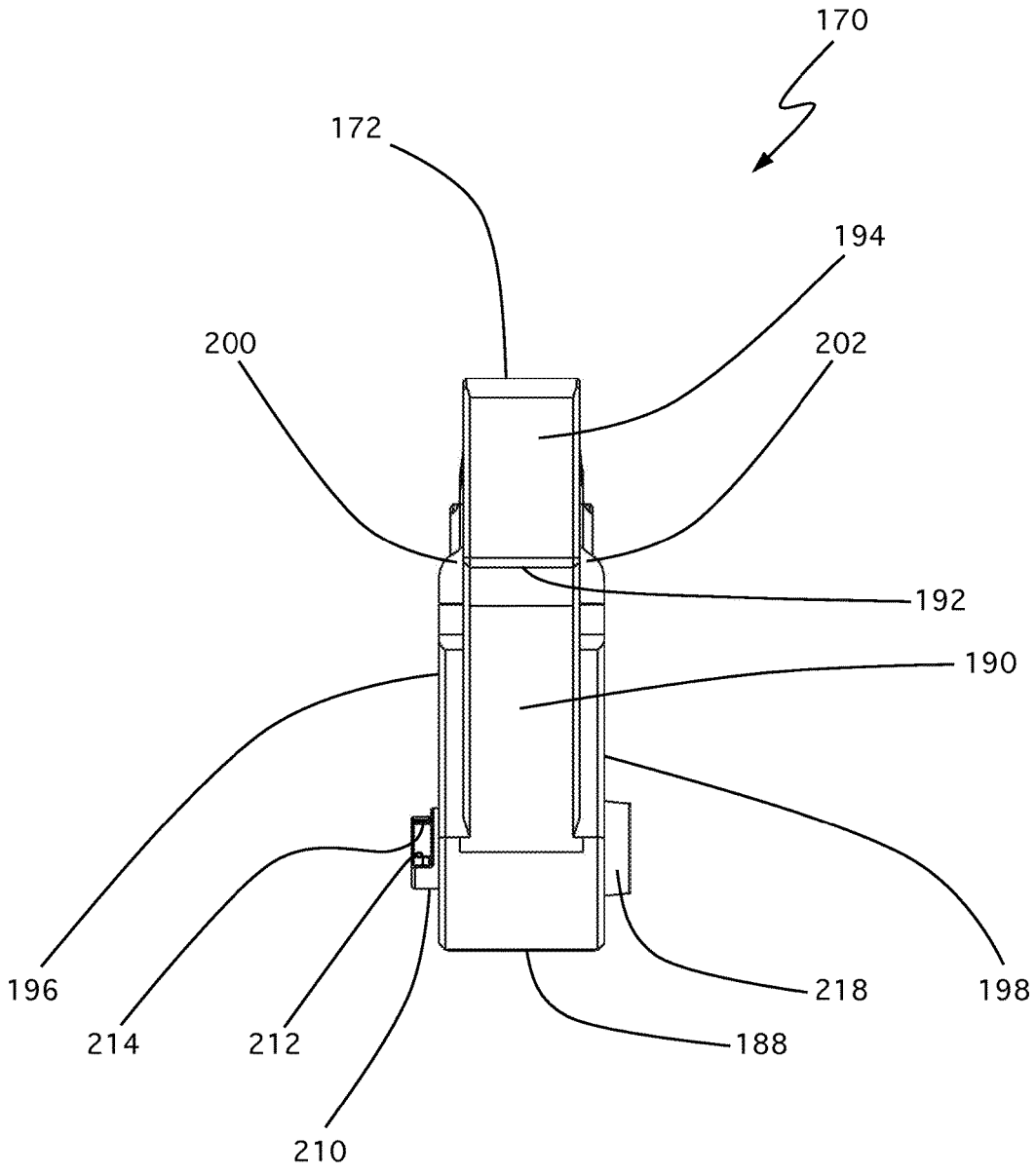
FIG. 12 is a rear view of the hammer assembly.

As best seen in FIG. 4, trigger assembly 20 further comprises disconnector shelf 34.

As seen in FIGS. 5, 6, 7, and 8, disconnector assembly 100 comprises first and second disconnector side faces 102 and 104 that define spring well 148 to house disconnector spring 154 seen in FIGS. 13, 14, and 15, and a disconnector stopper defined by disconnector stopper base end 126, disconnector stopper base 146, and disconnector stopper sidewalls 128 and 130.

Disconnector assembly 100 further comprises disconnector shroud 116 and disconnector shroud top face 124 that are sufficiently wide to cover spring well 148 and disconnector spring 154. Second disconnector side face 104 is a second predetermined distance from first disconnector side face 102. First and second disconnector side faces 102 and 104 comprise second trigger pin hole 106 that aligns with first trigger pin hole 48. Extending from spring well 148 is disconnector base 150 that extends to disconnector cam 152.

Disconnector assembly 100 further comprises disconnector tongue 108. Extending from disconnector tongue 108 is disconnector top face 110. Extending from disconnector top face 110 are first and second tapered disconnector shroud edges 112 and 114 respectively that define disconnector shroud 116. Disconnector shroud 116 is further defined by first and second disconnector shroud edges 132 and 134 respectively. First and second disconnector shroud edges 132 and 134 extend to first and second disconnector shroud side edges 142 and 144 respectively that define first and second disconnector shroud sidewalls 156. In a preferred embodiment, first and second disconnector shroud sidewalls 156 are countersunk to serve for debris deflection. In a preferred embodiment, the inside perimeters of the countersunk walls are filleted. Second disconnector shroud side edge 144 is a third predetermined distance from first disconnector shroud side edge 142. Disconnector assembly 100 further comprises disconnector sear forward curved wall 118 that extends to disconnector sear 120. Extending from disconnector sear 120 is disconnector sear forward face 122. In a preferred embodiment, disconnector assembly 100 is approximately symmetrical.

As seen in FIGS. 9, 10, 11, and 12, hammer assembly 170 comprises hammer interior walls 228. Protruding from hammer interior walls 228 are first and second hammer spring mounts 210 and 218 respectively to secure hammer spring 220, seen in FIGS. 13, 14, and 15. First and second hammer spring mounts 210 and 218 define hammer pin hole 216. First hammer spring mount 210 comprises hammer spring mount edges 212 and 214.

Hammer assembly 170 further comprises first and second hammer tapered shroud edges 200 and 202. Hammer assembly 170 further comprises first and second hammer spring shrouds 196 and 198 that extend from first and second hammer tapered shroud edges 200 and 202 respectively. First and second hammer spring shrouds 196 and 198 extend to hammer sear 186. Hammer assembly 170 further comprises third and fourth hammer spring shrouds 238. In a preferred embodiment, with the exception of first and second hammer spring mounts 210 and 218, hammer assembly 170 is approximately symmetrical. The third and fourth hammer spring shrouds 238 extend from hammer sear 186 to first and second hammer shroud ends 240 respectively. The first, second, third and fourth hammer spring shrouds 196, 198, and 238 are sufficiently wide to partially cover hammer spring 220 that is encased and snaps onto hammer assembly 170 to remain secured thereon without play. Hammer assembly 170 further comprises first and second countersunk walls 224 to serve as for debris deflection, and have at least one debris hole 226 to reduce debris accumulation therein. In a preferred embodiment, the inside perimeters of the countersunk walls are filleted.

Hammer assembly 170 comprises ridge 172. Extending from ridge 172 is hammer top wall 174 that extends to hammer disconnector sear 176. Extending from hammer disconnector sear 176 is hammer end 178. Hammer assembly 170 further comprises first and second debris bevels 230 and 232 that extend to first and second hammer sidewalls 234 and 236 respectively that define trigger sear 180. Extending from trigger sear 180 is hammer curved wall 182 that extends to hammer wall 184. Hammer assembly 170 further comprises hammer base 188 that extends to hammer forward wall 190. Hammer forward wall 190 extends to hammer forward wall end 192. Hammer assembly 170 further comprises hammer forward end wall 194 that extends between hammer forward wall end 192 and ridge 172.

Seen in FIG. 13 is a side elevation view of present invention 10 mounted onto firearm model F in an at rest position, with trigger spring 58, disconnector spring 154, and hammer spring 220 mounted on trigger assembly 20, disconnector assembly 100, and hammer assembly 170 respectively.

Seen in FIG. 14 is a side elevation view of present invention 10 mounted onto firearm model F in a cocked position, with trigger spring 58, disconnector spring 154, and hammer spring 220 mounted on trigger assembly 20, disconnector assembly 100, and hammer assembly 170 respectively.

Seen in FIG. 15 is a side elevation view of present invention 10 mounted onto firearm model F in a reset position, with trigger spring 58, disconnector spring 154, and hammer spring 220 mounted on trigger assembly 20, disconnector assembly 100, and hammer assembly 170 respectively. It is noted that legs of hammer spring 220 are biased against trigger spring mount ends 44 and 46, and 54 and 56.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus comprising:

A) a trigger assembly comprising first and second housing side edges, said second housing side edge is a first predetermined distance from said first housing side edge, said first and second housing side edges each define first and second housing sidewalls respectively, said first and second housing sidewalls define an elongated cavity having an end, protruding are first and second trigger spring mounts to secure a trigger spring, said first and second trigger spring mounts define a first trigger pin hole, said trigger assembly further comprising first and second shroud side edges that define an angled face, said angled face tapers outwardly towards said end without reaching said end, said trigger assembly further comprising a trigger;

B) a disconnector assembly comprising first and second disconnector side faces that define a spring well to house a disconnector spring, and a disconnector stopper, said disconnector assembly further comprises a disconnector shroud and disconnector shroud top face that are sufficiently wide to cover said spring well and said disconnector spring; and C) a hammer assembly having first and second hammer spring mounts to secure a hammer spring.

2. The trigger assembly improved set forth in claim 1, further characterized in that said angled face is sufficiently wide to partially cover said trigger spring.

3. The trigger assembly improved set forth in claim 1, further characterized in that said first and second housing sidewalls are countersunk to serve for debris deflection.

4. The trigger assembly improved set forth in claim 1, further characterized in that said first and second housing sidewalls comprise at least one debris hole to reduce debris accumulation therein.

5. The trigger assembly improved set forth in claim 1, further characterized in that said trigger assembly further comprises first and second trigger assembly shroud sidewalls.

6. The trigger assembly improved set forth in claim 5, further characterized in that said first and second trigger assembly shroud sidewalls are countersunk to serve for debris deflection.

7. The trigger assembly improved set forth in claim 1, further characterized in that said angled face extends to a rounded top edge.

8. The trigger assembly improved set forth in claim 1, further characterized in that said trigger assembly further comprises an aft face and a trigger sear.

9. The trigger assembly improved set forth in claim 1, further characterized in that said second disconnector side face is a second predetermined distance from said first disconnector side face, said first and second disconnector side faces comprise a second trigger pin hole that aligns with said first trigger pin hole.

10. The trigger assembly improved set forth in claim 9, further characterized in that said disconnector assembly further comprises a disconnector tongue, extending from said disconnector tongue is a disconnector top face, extending from said disconnector top face are first and second tapered disconnector shroud edges that define said disconnector shroud.

11. The trigger assembly improved set forth in claim 10, further characterized in that said disconnector shroud is further defined by first and second disconnector shroud edges, said first and second disconnector shroud edges extend to first and second disconnector shroud side edges respectively, said second disconnector shroud side edge is a third predetermined distance from said first disconnector shroud side edge.

12. The trigger assembly improved set forth in claim 1, further characterized in that said disconnector assembly further comprises first and second disconnector shroud sidewalls that are countersunk to serve for debris deflection.

13. The trigger assembly improved set forth in claim 1, further characterized in that said hammer assembly further comprises first and second hammer tapered shroud edges.

14. The trigger assembly improved set forth in claim 13, further characterized in that said hammer assembly further comprises first and second hammer spring shrouds that extend from said first and second hammer tapered shroud edges respectively.

15. The trigger assembly improved set forth in claim 14, further characterized in that said first and second hammer spring shrouds extend to a hammer sear.

16. The trigger assembly improved set forth in claim 15, further characterized in that said hammer assembly further comprises third and fourth hammer spring shrouds.

17. The trigger assembly improved set forth in claim 16, further characterized in that said third and fourth hammer spring shrouds extend from said hammer sear.

18. The trigger assembly improved set forth in claim 17, further characterized in that said third and fourth hammer spring shrouds extend from said hammer sear to first and second hammer shroud ends respectively.

19. The trigger assembly improved set forth in claim 18, further characterized in that said first, second, third and fourth hammer spring shrouds are sufficiently wide to encase and partially cover said hammer spring.

20. The trigger assembly improved set forth in claim 1, further characterized in that said hammer assembly further comprises first and second debris bevels that extend to first and second hammer sidewalls respectively.

21. The trigger assembly improved set forth in claim 1, further characterized in that said hammer assembly further comprises first and second hammer assembly sidewalls.

22. The trigger assembly improved set forth in claim 21, further characterized in that said first and second hammer assembly sidewalls are countersunk to serve for debris deflection.

23. The trigger assembly improved set forth in claim 21, further characterized in that said first and second hammer assembly sidewalls comprise at least one debris hole to reduce debris accumulation therein.

* * * * *